US006124519A

United States Patent [19]

Sako et al.

[11] Patent Number: 6,124,519

[45] Date of Patent: Sep. 26, 2000

[54] METHOD OF DECOMPOSING POLYCHLOROBIPHENYLS

[75] Inventors: Takeshi Sako, Tsukuba; Masahito Sato, Chikushino; Tsutomu Sugeta; Katsuto Otake, both of Tsukuba; Makoto Okano, Toride, all of Japan

[73] Assignee: Director-General of Agency of Industrial Science and Technology, Japan

[21] Appl. No.: 08/990,025

[22] Filed: Dec. 12, 1997

[30] Foreign Application Priority Data

Dec. 13, 1996 [JP] Japan ..... 8-333205

[51] Int. Cl.[7] ..... A62D 3/00

[52] U.S. Cl. ..... 588/205; 588/206; 588/207; 588/208; 588/213

[58] Field of Search ..... 588/205, 206, 588/207, 208, 213, 256

[56] References Cited

U.S. PATENT DOCUMENTS

| | | | |
|---|---|---|---|
| 4,113,446 | 9/1978 | Modell et al. | 48/202 |
| 4,351,978 | 9/1982 | Hatano et al. | 585/469 |
| 4,353,793 | 10/1982 | Brunelle | 208/262 |
| 4,387,018 | 6/1983 | Cook et al. | 208/262 |
| 4,416,767 | 11/1983 | Jordan | 208/262 |
| 4,430,208 | 2/1984 | Pytlewski et al. | 208/262 |
| 4,469,661 | 9/1984 | Shultz | 423/210.5 |
| 4,497,782 | 2/1985 | Howell et al. | 423/184 |
| 4,612,404 | 9/1986 | Thyagarajan | 568/730 |
| 4,764,256 | 8/1988 | Way | 203/46 |
| 4,822,379 | 4/1989 | Thompson | 44/589 |
| 5,133,877 | 7/1992 | Rofer et al. | 210/761 |
| 5,393,394 | 2/1995 | Ikeda et al. | 204/158.2 |
| 5,543,057 | 8/1996 | Whiting et al. | 210/721 |
| 5,560,822 | 10/1996 | Bond et al. | 210/181 |
| 5,837,149 | 11/1998 | Ross et al. | 210/759 |

FOREIGN PATENT DOCUMENTS

| | | |
|---|---|---|
| 8100854 | 2/1981 | WIPO . |
| 9510486 | 4/1995 | WIPO . |
| 9617680 | 6/1996 | WIPO . |

OTHER PUBLICATIONS

Chemical Abstracts, vol. 126, No. 6, Feb. 10, 1997.
Waste Treatment Technology Series vol. 1, 1990 pp. 31–42.
Chemical Abstracts, vol. 128, 52498, 1997.

*Primary Examiner*—Tom Dunn
*Assistant Examiner*—Cam N. Nguyen
*Attorney, Agent, or Firm*—Lorusso & Loud

[57] ABSTRACT

A method of decomposing a polychlorobiphenyl compound-containing material into an unharmful state, wherein the material is treated with a supercritical water containing an alkaline substance at a temperature higher than the critical temperature of water and a pressure higher than the critical pressure of water.

13 Claims, No Drawings

METHOD OF DECOMPOSING POLYCHLOROBIPHENYLS

BACKGROUND OF THE INVENTION

Polychlorobiphenyls (hereinafter referred to as PCBs) were used in a wide variety of applications such as insulating oil, machine oil, plasticizers and paints, because of excellent insulating properties, good solubility in oils and low vaporizability thereof. In 1966, PCBs, which are harmful to human bodies and chemically extremely stable, were found to cause environmental pollution and to be stored in a high concentration within living beings through food chains. Thus, early in 1970s, the manufacture of PCBs was prohibited. As a result, a total of about $10^6$ tons of PCBs have been stored in the world. There is a great demand for the establishment of technology for decomposing PCBs.

Known methods hitherto proposed for the decomposition of PCBs include (a) combustion at a temperature of at least 1,100° C., (b) catalytic hydrogenation, (c) photochemical decomposition with UV rays, and (d) biological decomposition using microorganisms. These methods are not fully satisfactory with respect to energy consumption, treatment time, equipment cost or formation by-products.

JP-B-2590421 discloses a method of decomposing PCBs, wherein PCBs are contacted with an aqueous solution containing an oxidizing agent at a temperature of 623 K–823 K and a pressure of 20–60 MPa. The presence of the oxidizing agent is described as being essential in order to effectively decompose PCBs. This method is promising because PCBs can be effectively decomposed within a relatively short period of time but has a problem because the oxidizing agent cause corrosion of the treatment apparatus and decomposition of other useful materials such as oil in which PCBs are contained.

SUMMARY OF THE INVENTION

It is, therefore, an object of the present invention to provide an industrially suitably applicable method which can effectively decompose PCBs and which is devoid of the drawbacks of the conventional methods.

It is a special object of the present invention to provide a method of decomposing PCBs contained in an oil while permitting the recovery of the oil.

In accomplishing the foregoing objects, there is provided in accordance with the present invention a method of decomposing a polychlorobiphenyl compound-containing material, comprising treating said material with supercritical water containing an alkaline substance at a temperature higher than the critical temperature of water and a pressure higher than the critical pressure of water.

It has been found that PCBs, when treated with supercritical water containing an alkaline substance, can be decomposed into, biphenyl, phenol, carbon dioxide, etc. without using an oxidizing agent. Since hydrogen chloride formed in situ by the decomposition of PCBs is neutralized with the alkaline substance, no corrosion of the reactor is caused. Further, when the PCB-containing material is a PCB-containing oil, the oil can be recovered after the decomposition of PCBs.

DETAILED DESCRIPTION OF THE PREFERRED EMBODIMENTS OF THE INVENTION

Any PCB-containing material, either in the form of a liquid or a solid, may be treated in accordance with the present invention. The concentration of PCBs in the material to be treated generally ranges from 0.001% by weight up to 100% by weight. PCBs are often contained in oils such as insulating oils composed of mineral oils and alkylbenzenes. Such PCB-containing oils are suitably treated by the method of the present invention, while recovering the oils.

The PCB-containing material is fed to a reactor and is heated together with water in the presence of an alkaline substance at a temperature higher than the critical temperature of water, i.e. at a temperature higher than 647.3 K, preferably 653–873 K, more preferably 653–773 K, and at a pressure higher than the critical pressure of water, i.e. at a pressure higher than 22.12 MPa, preferably 22.12–40 MPa, more preferably 25–35 MPa. The treatment time is generally 3–120 minutes, preferably 5–60 minutes.

The alkaline substance is preferably a weak acid salt or hydroxide of an alkali metal or an alkaline earth metal. Illustrative of preferable alkaline substances are sodium hydroxide, potassium hydroxide, sodium carbonate and calcium hydroxide. The alkaline substance is generally used in an amount of 1–15 parts by weight per part by weight of PCBs. For reasons of costs, sodium hydroxide is preferably used as the alkaline substance in an amount of 2–10 equivalents per equivalent of the chlorine atoms contained in PCBs.

The amount of water present in the reactor is generally 50–150 parts by weight per part by weight of PCBs contained in the PCB-containing material to be treated.

The following examples will further illustrate the present invention.

EXAMPLES 1–3

In an autoclave were charged water, PCBs and sodium hydroxide in amounts as shown in Table 1. The mixture was then treated at a temperature of 723 K and a pressure of 30 MPa for 20 minutes. The mixture after the treatment was analyzed for the amount of residual PCBs. The PCB decomposition rate Z (%) was calculated according to the following formula:

$$Z=(W_0-W_1)/W_0\times 100$$

where $W_0$ represents the amount of PCBs charged in the autoclave and $W_1$ is the amount of PCBs remaining in the reaction mixture after the treatment. The results are also shown in Table 1.

TABLE 1

| Example No. | Amount of PCBs (mg) | Amount of Water (g) | Amount of NaOH* | Decomposition Rate Z (%) |
|---|---|---|---|---|
| 1 | 10.05 | 1.332 | 3.2 | 99.99 |
| 2 | 10.64 | 1.331 | 5.0 | 99.93 |
| 3 | 11.04 | 1.328 | 9.7 | 99.99 |

*Equivalent (mole) of NaOH per one equivalent (one mole) of the chlorine atoms of PCBs

EXAMPLES 4–6

In an autoclave were charged water, a PCB-containing insulating oil (content of PCBs: about 2% by weight) and sodium hydroxide in amounts as shown in Table 2. The mixture was then treated at a temperature of 723 K and a pressure of 30 MPa for 20 minutes in Examples 4 and 5. The reaction conditions in Example 6 involved a temperature of 653 K, a pressure of 30 MPa and a time of 20 minutes. The PCB decomposition rate is shown in Table 2. The insulating oil remaining in the mixture after the treatment was found not to be deteriorated.

TABLE 2

| Example No. | 4 | 5 | 6 |
|---|---|---|---|
| Amount of PCB-Containing Oil (mg) | 49.93 | 49.73 | 50.04 |
| Amount of PCBs (mg) | 1.03 | 1.02 | 1.03 |
| Amount of Water (g) | 1.336 | 1.332 | 4.780 |
| Amount of NaOH* | 4.9 | 9.7 | 9.7 |
| Decomposition Rate Z (%) | 99.45 | 99.79 | 99.63 |

*Equivalent (mole) of NaOH per one equivalent (one mole) of the chlorine atoms of PCBs The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A method of decomposing a polychlorobiphenyl compound-containing material, comprising treating said material with a supercritical water containing an alkali metal hydroxide, at a temperature higher than the critical temperature of water and a pressure higher than the critical pressure of water, to decompose the polychlorobiphenyl compound, wherein said treating is conducted without using an oxidizing agent.

2. A method as claimed in claim 1, wherein said treatment is performed at a temperature 653–873 K and a pressure of 22.12–40 MPa.

3. A method as claimed in claim 1, wherein said alkali metal hydroxide is present in an amount of 1–15 parts by weight per part by weight of said polychlorobiphenyl compound.

4. A method as claimed in claim 1, wherein said alkali metal hydroxide is sodium hydroxide.

5. A method as claimed in claim 4, wherein said sodium hydroxide is present in an amount of 2–10 equivalents per equivalent of the chlorine atoms contained in said polychlorobiphenyl compound.

6. A method as claimed in claim 1, wherein said water is present in an amount of 50–150 parts by weight per part by weight of said polychlorobiphenyl compound.

7. A method as claimed in claim 1, wherein said polychlorobiphenyl compound-containing material consists essentially of polychlorobiphenyl compounds.

8. A method as claimed in claim 1, wherein said polychlorobiphenyl compound-containing material is a mixture containing polychlorobiphenyl compounds and an oil.

9. A method as claimed in claim 8, wherein said oil is an insulating oil.

10. A method as claimed in claim 8 further comprising recovering said oil after decomposing the polychlorobiphenyl compound.

11. A method as claimed in claim 1 wherein said alkali metal hydroxide is present in said supercritical water in an amount sufficient to neutralize hydrogen chloride formed in situ by decomposition of said polychlorobiphenyl compound-containing material.

12. A method as claimed in claim 1 wherein said alkali metal hydroxide is potassium hydroxide.

13. A method as claimed in claim 1 wherein said treating is conducted in a single step.

* * * * *